United States Patent [19]

Pollini et al.

[11] Patent Number: 4,599,072

[45] Date of Patent: Jul. 8, 1986

[54] EQUIPMENT FOR MOVEMENT ON WATER SURFACE AND TOWLESS AQUATIC SKI

[75] Inventors: Piero Pollini, San Maurizio d'Opaglio; Giovanni M. Bertelé, Via Roma-Condominio 5 Colli, 22040 Lurago d'Erba, Como; Ettore Comoli, Sostegno, all of Italy

[73] Assignees: Giovanni Marco Bertelé; Alessandro Salice, both of Italy

[21] Appl. No.: 589,357

[22] Filed: Mar. 14, 1984

[30] Foreign Application Priority Data

Mar. 14, 1983 [IT] Italy ..... 84603 A/83
Sep. 1, 1983 [IT] Italy ..... 22732 A/83

[51] Int. Cl.[4] ..... A63C 15/00

[52] U.S. Cl. ..... 441/65; 441/68; 441/70; 441/73; 441/76

[58] Field of Search ..... 114/77 R, 61, 352; 440/101, 104, 107, 13, 17, 36; 441/65, 76, 77, 73, 72; 24/524, 568; 292/113, 66, DIG. 9, 247; 403/167, 384, 321, 322, 324; 248/534, 538, 539

[56] References Cited

U.S. PATENT DOCUMENTS

| | | | |
|---|---|---|---|
| 885,866 | 4/1908 | Roy | 292/66 |
| 1,719,059 | 7/1929 | Krupka et al. | 441/77 |
| 2,144,207 | 1/1939 | Tiefel | 280/615 |
| 2,390,181 | 12/1945 | Sarthou | 280/606 |
| 2,894,760 | 7/1959 | Kolstad | 441/65 |
| 2,940,090 | 6/1960 | Fournier | 441/77 |
| 3,034,157 | 5/1962 | Abajian | 441/77 |
| 4,293,968 | 10/1981 | Levine | 441/73 |

FOREIGN PATENT DOCUMENTS

| | | | |
|---|---|---|---|
| 647760 | 7/1937 | Fed. Rep. of Germany | 440/101 |
| 1904719 | 8/1970 | Fed. Rep. of Germany | 292/66 |
| 3132033 | 3/1983 | Fed. Rep. of Germany | 441/73 |
| 492556 | 7/1919 | France | 441/77 |
| 33991 | 9/1921 | Switzerland | 441/77 |
| 1375865 | 11/1974 | United Kingdom | 114/352 |

*Primary Examiner*—Trygve M. Blix
*Assistant Examiner*—Edwin L. Swinehart
*Attorney, Agent, or Firm*—Steinberg & Raskin

[57] ABSTRACT

Equipment for movement on water surface and towless aquatic ski, comprising two hollow shoes for supporting a user under condition of static floatage, which shoes are provided with flexible connections for accomodating the user's feet, and at least one movable stabilizing fin, and two sticks with rotatable hollow rackets, peripherally provided with inclined tabs, for thrust impact on the water surface; the shoes are formed of two portions which are interconnected by an articulated joint, to be movable with respect to each other, and the rear portion is fitted with at least one fin.

19 Claims, 14 Drawing Figures

EQUIPMENT FOR MOVEMENT ON WATER SURFACE AND TOWLESS AQUATIC SKI

BACKGROUND OF THE INVENTION

This invention relates to an equipment for movement on water surface and towless aquatic ski.

Known are equipments for strolling about on water surface and practicing towless aquatic ski sport, which comprise a pair of shoes or integral floating ski, where a user will slip his or her feet in cavities in said shoes, as well as a pair of sticks provided at the bottom with a water impact racket. By these shoes or ski the forward movement or advancement occurs by a strolling about movement similar to walking. Such known equipments suffer from a number of drawbacks. First, such equipments lack in stability, particularly in the presence of wave motion do not allow a proper governability, do not allow to impart a suitable thrust by the sticks, do not allow to use such sticks as connecting means for the shoes to obtain a catamaran structure, particularly useful in case of emergency.

SUMMARY OF THE INVENTION

It is the object of the present invention to provide an equipment of increased stability or governability as far as the shoes are concerned on one hand and on the other hand a thrust effect or reaction more effective of the rackets on the other side.

This object, in addition to further objects which will become more apparent from the following detailed description, are accomplished by an equipment comprising elongated floating bodies and means for accommodating a user's feet, which equipment is essentially characterized in that said bodies are formed of at least two floating sections, namely front and back sections, interconnected by an articulated joint, wherein the foot receiving means are placed in the front section.

BRIEF DESCRIPTION OF THE DRAWINGS

Further characteristics, advantages and details of an equipment according to the invention will become more apparent from the following description with reference to the accompanying drawings, in which the shoes and rackets according to the invention are schematically shown in a preferred, but unrestrictive embodiment.

In the drawings.

DETAILED DESCRIPTION OF THE PREFERRED EMBODIMENTS

Figure 1:
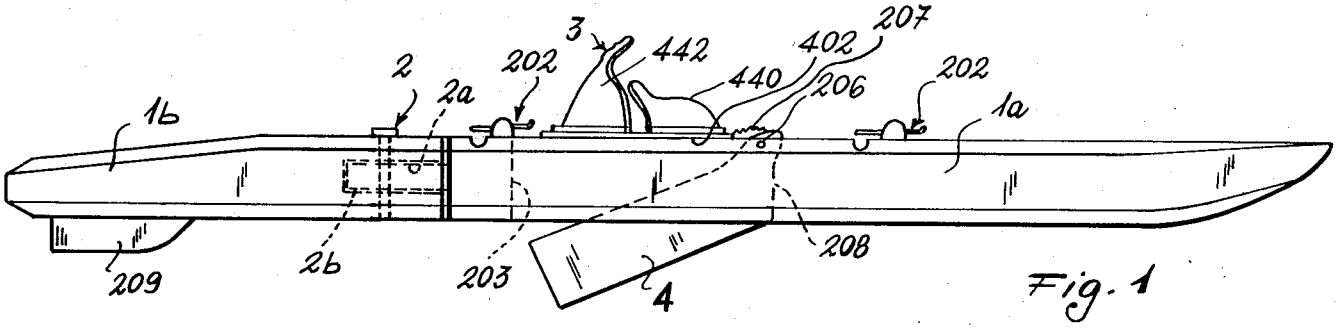
FIG. 1 is a side elevational view of an articulated shoe according to the invention.
Figure 2:
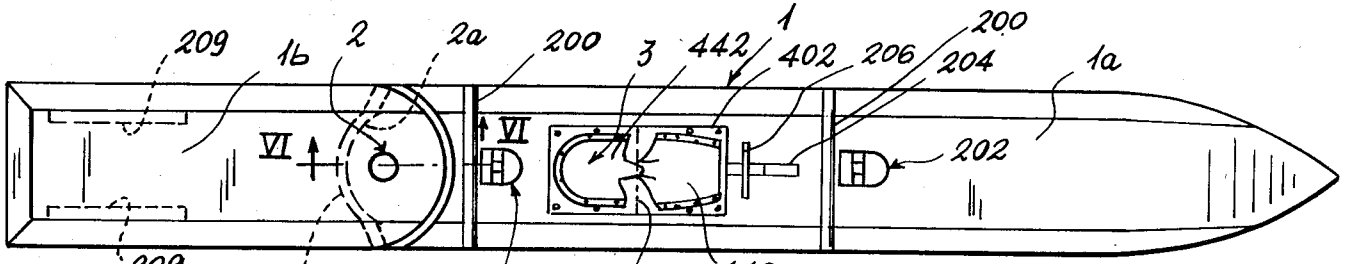
FIG. 2 is a top view thereof.
Figure 3:
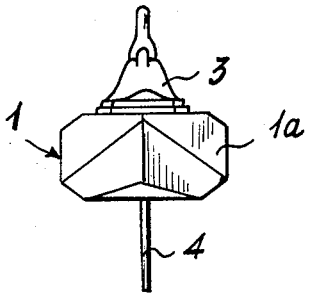
FIG. 3 is a leading front view of the shoe shown in FIGS. 1 and 2.

A shoe according to the present invention is shown as a whole at 1. Said shoe is sealingly hollow and is of substantially parallelepiped elongated flat shape, slightly convex at the bottom thereof acting as a keel and at the front configurated as a prow for improving the effect of hydrodynamic penetration.

Said shoe 1 has a front section 1*a* and a back or rear section 1*b*, which are interconnected by an articulated joint 2. Particularly, the front section has at about midway a lug 2*a* which is arranged within a substantially U-shaped cavity 2*b*, in the facing or opposite end of the other section 1*b*. Said lug 2*a* has a hole 2*c* for the passage of a pin 2*d* having a threaded end (at 2*e*) screwing into a corresponding threaded hole 2*de* provided in the lower side of the cavity 2*b*, and through a hole 2*g* in the upper side 2*h* of said cavity.

On its outer side, said lug 2*a* has a groove 2*m* perpendicular to the longitudinal axis of section 1*a*, while on the bottom face 2*p* of said cavity 2*b* there is a seat 2*r* partly accommodating a ball or sphere of hard resilient material 2*s*, the cap of which projecting from the seat 2*r* is arranged in said groove 2*m* of lug 2*a*. This is for resiliently automatically aligning the two sections 1*a*, 1*b* of the shoe.

Practically, the proposed articulation for the shoe has the advantage of reducing during directional changes the bending radius. There is also provided an increase in stability in case of pitching and rolling. Thus, the shoe is given a considerable elasticity and flexibility, as well as dismantling capability with resulting simplification in transport.

In addition, if desired, the articulation can be clamped according to the invention by a suitable per se known device which, for example, consists in the simplest embodiment of a further pin element, like the pin 2, inserted in coaxial through similar to those receiving said pivot pin 2.

Reference numeral 3 denotes a receiving means for a foot. Such means should conveniently allow an easy foot unslip, for example in case of user's upsetting, and can be advantageously adjustable, as described in the following in connection with FIGS. 10 to 14. Such means are secured to the upper face of front section 1*a*.

Figure 4:
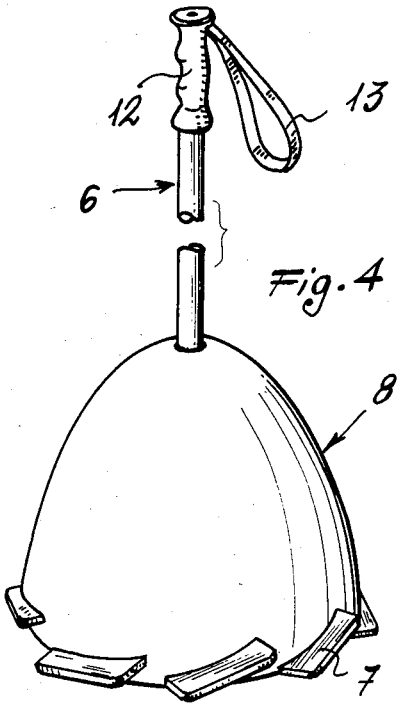
FIG. 4 is a perspective view of a stick with racket according to the invention.
Figure 5:
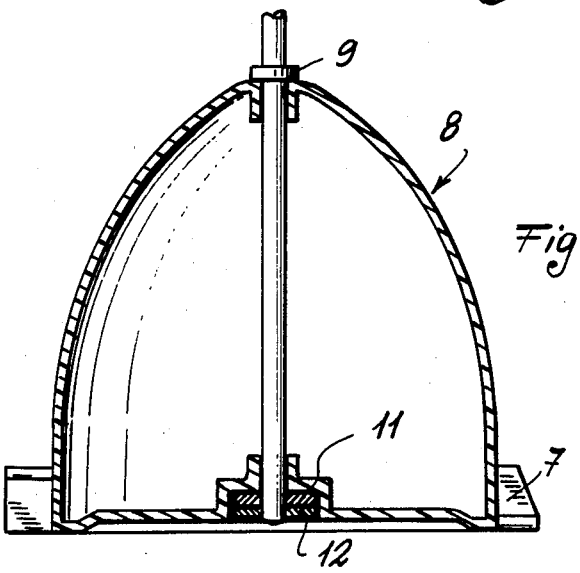
FIG. 5 is a longitudinal sectional view of the illustration of FIG. 4 according to the present invention.
Figure 6:
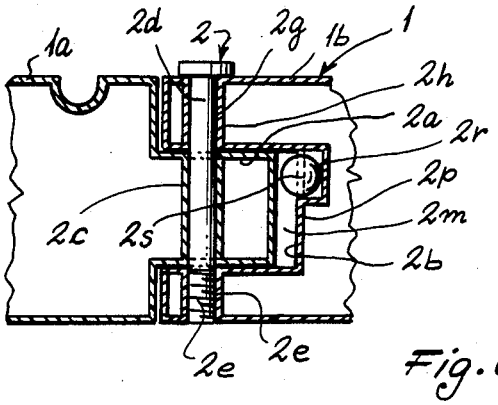
FIG. 6 is a sectional view taken along line VI—VI of FIG. 2.
Figure 7:
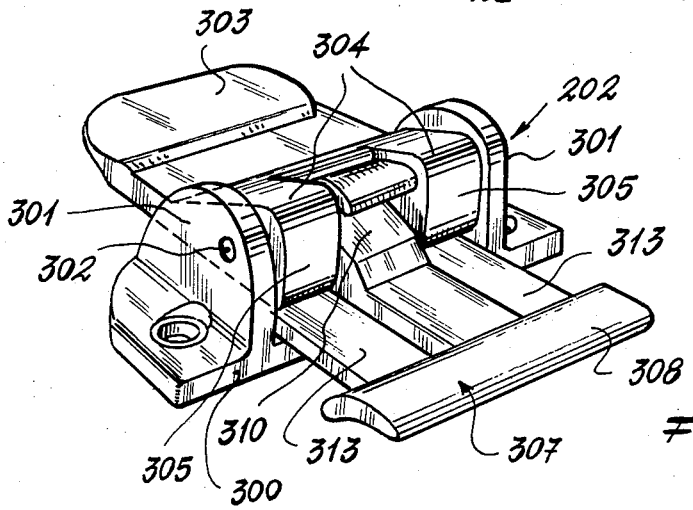
FIG. 7 is a perspective view of the stick clamping device to provide a rotary catamaran, schematically shown in the plan view of FIG. 9.
Figure 8:
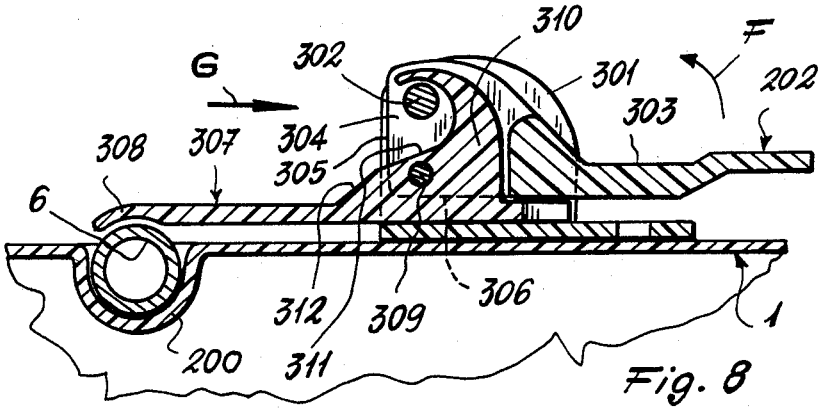
FIG. 8 is a longitudinal sectional view of the device of FIG. 7, at stick clamping position.
Figure 9:
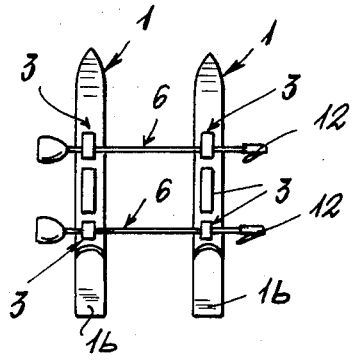
FIG. 9 is a plan view of the two sticks connecting the two shoes in a floating catamaran structure.

In the front section 1*a* and on the upper face of such a section, there are also provided two transverse parallel grooves 200, in which a user can place the two sticks 6, as normally used a propulsors and which are shown in FIGS. 4 and 5, for interconnection (as shown in FIG. 9) of the two shoes 1 of the equipment to provide a catamaran structure. In order to restrain the sticks 6 in said grooves, use is made of lever devices 202, shown in FIGS. 7 and 8, which are secured by means of screws to the front section 1*a* of shoes 1.

Still in said front section 1*a* and centrally thereof, a slit 203 is provided as defined by walls for the required sealing of said section 1*a*, opening at the bottom with a wide port and at the top with a narrow port 204. A movable fin 205 is guided in (and can re-enter) in said slit, which fin is pivoted on a pin 206 forcibly secured in a cross groove in the upper face of section 1*a*. One end of said movable fin 205 projects from the narrow port 204 and has connected thereto a traction spring 207, which is connected with said means 3 and serves to maintain said fin 205 at the position of FIG. 1, where the front lower side of the latter bears against a closing wall 208 of slit 203.

At stern, the back or rear section 1*b* has two small fixed parallel fins 209.

The eqiupment comprises sticks 6 which at the top have a per se known handgrip portion 12 (such as ski sticks) and at the bottom a rotatable body or racket 8.

Such a body or racket 8 has a preferably substantially closed bell configuration provided along the lower contour with a crown of inclined blades 7. The body 8 is passed through by the stick 6 in suitable holes and is rotatably retained thereon by means of an upper ring 9 integral the stick and at the bottom by a ring 11 and an elastically deformable ring 12 secured to the stick. A conventional handgrip 12 with strap 13 is secured to the upper end of stick 6. The means 12 and 13 can be those used in ski sticks.

The rotation given to the thrust body 8 through the blades 7 causes the water discharge. The elasticity of body 8 (made of plastics material) also aids in release step (that is after thrust) the stick lifting, reducing the user's fatigue.

The clamping devices 202, used for providing the catamaran structure of FIG. 9, are identical to one another and secured by means of screws to the upper face of section 1*a* adjacent the cross grooves 200. They comprise a support block 300 provided with two parallel sides 301 carrying a transverse pin 302. A lever 303 is rotatable about this pin terminating as a fork at the pin, that is with two parallel jaws 304 frontally defined at 305 and at the bottom at 306, by two faces which are nearly perpendicular to each other.

The actual clamping element is placed between said two jaws 304 and terminates with a bottom concave transverse portion 308, this clamping element 307 being pivoted by a pin 309 to said two jaws at a ridge 310 thereof having a groove 311 with an inclined plane lead-in. The first mentioned pin 302 freely extends in said groove 311. At the position shown in FIGS. 7 and 8, position corresponding to the clamping of stick 6 located in the groove 200, the two pins 302 and 309 (eccentric to each other) lie on a same vertical plane. Since the element 307 is with its wings or limbs 313 under the faces 306 of the jaws 304 of said lever 303, the stick 6 is prevented from falling out of the groove 202 in which it has been placed.

The release of stick 6 can be obtained by simple rotation of lever 303 in the direction of arrow F. This rotation about the fixed pin 302 causes a rotation of pin 309 about the former (that is about pin 302) and accordingly a displacement of element 307 substantially in the direction of the arrow G, or more particularly its movement away from the inlet of groove 200, which allows the removal of stick 6.

Figure 10:
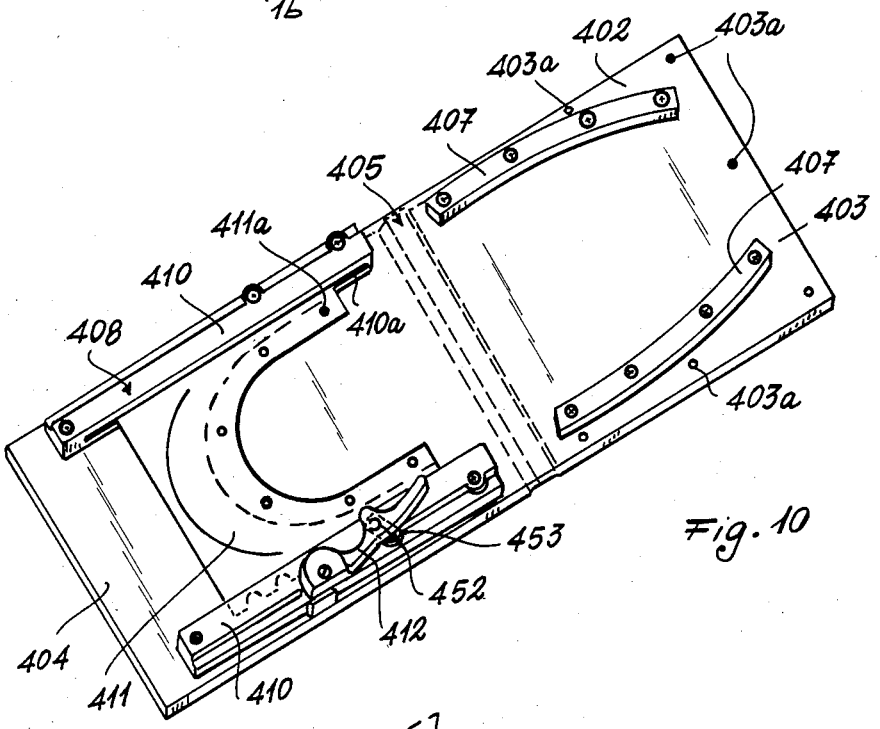
FIG. 10 is a perspective view showing the means for receiving the user's foot.
Figure 11:
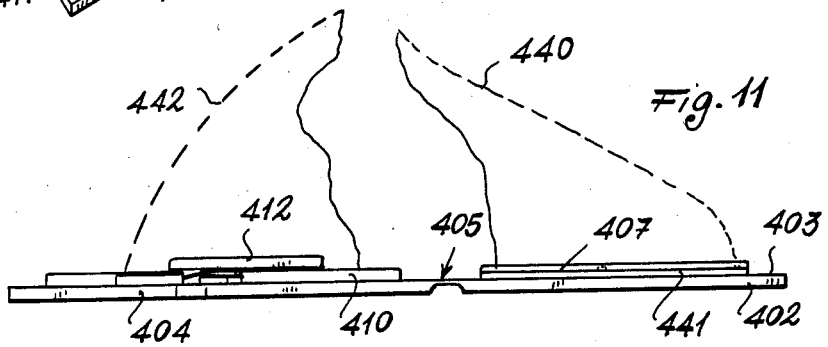
FIG. 11 is a side view of the means shown in FIG. 10.

The foot receiving means, indicated at 3 and more particularly shown in FIGS. 10 and 11, allow on one hand a good operability of shoes 1 under any use condition thereof, and on the other hand the possibility of carrying out an easy and fast strolling about, which as a result leads to an improvement of equilibrium conditions for a user, by excluding the assumption of unnatural positions, due both the nature of the carrier means, that is water, and the type of strilling about by sliding.

The receiving means 3 comprise an integral support plate 402 having a front portion 403 and a rear portion 404, between which a groove is provided acting as a hinge or pivot 405, for enabling an oscillation movement of the rear portion 404 relative to the front portion 403. At the tip and about midway, the latter is provided with holes through which screws 403*a* extend, then at some distance from said groove 405 with holes for screws 403*a* for screw fastening on shoe 1.

Reference numeral 407 indicates positioning and clamping sections for the front portion 440 of a per se known footwear, that is of the type similar to that used for aquatic tow ski sport, made of resilient material and such a portion 404 being provided with a fastening flange 441 which is clamped between the fillets 407 and plate 402. Reference numeral 408 further denotes a clamping device for the footwear rear portion 442, or heel.

More particularly, reference numeral 410 denotes sections internally grooves at 410*a*, 411 denotes a plate slidable in said grooves with fastening holes 411*a* by screws, rivets or the like of the footwear rear portion 442, while reference numeral 412 denotes a spring lever provided with a stop pin 452, entering a groove 453 of section 410 and one of a series of notches on the side of plate 411 which is guided in the section 410 where the lever 412 is located.

The rear portion 442 also has a lower contour flange, on which a horse-shoe body is placed and the flange is clamped between the plate 411 and the horse-shoe body by means of screws. This is per se well known in the field of tow water ski sport.

By the proposed solution, that is by turnability of the plate about the hinge or pivot 405 and its fastening at the front portion and intrinsic flexibility of the plate made of plastics material, the conditions are created both for an improved governability of the shoe, and also for an improved advancement guide thereof during the foot advancement movement. Moreover, the pivoting at the median zone of the foot sole, both allows to carry out step movements as natural as possible, since the foot is given full freedom of movement, and a more centered application of the user's weight, thereby substantially avoiding the effects of "stumbling" or sinking movements of the shoe tip. The sum of all these features obtained by the combination of fastening of the footwear front portion to the shoe and pivoting at the foot median zone and plate flexibility allow a perfect control and governability of the shoes even in the presence of the most unfavourable conditions as possible, that is to say during use thereof on water-courses with varying currents and slide directions, as well as with obstacles, such as stones and rocks, as particularly found in rivers, streams and the like.

Figure 12:
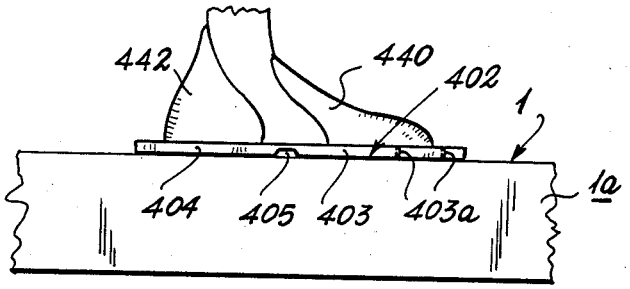
FIGS. 12 to 14 are side principle views showing the movements allowed by the means shown in FIGS. 10 and 11.
Figure 13:
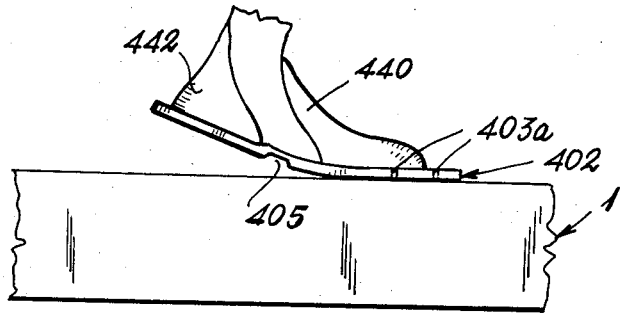
Figure 14:
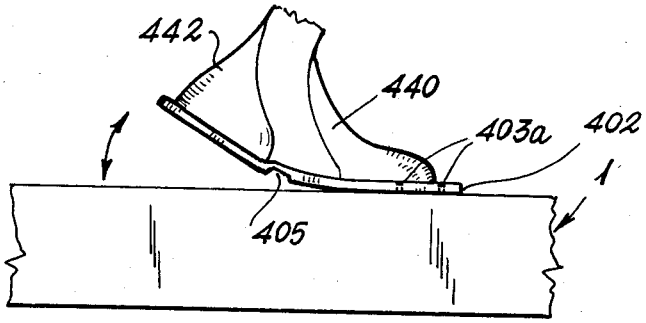

During strolling about, as shown in FIGS. 12 to 14, the rear portion of plate 402 rotates about the hinge or pivot 405, while the front portion thereof slightly deflects at the free portion, that is at the length between such a hinge or pivot and the first fastening screws 403*a*.

What is claimed is:

1. A water ski, comprising an elongated body, said elongated body composed of a plurality of floating sections, a front section and a rear section, means for receiving a foot, said foot receiving means associated with said front section of said elongated body, an articulated joint interconnecting said front and rear sections of said elongated body, said articulated joint being pivoted about a mean vertical longitudinal plane of said elongated body, and means for resiliently longitudinally aligning said front and rear sections with respect to one another, wherein said articulated joint comprises a substantially U-shaped recess, in one of said front and rear sections, a lug extending from the other of said front and rear sections and adapted to fit into said U-shaped recess, a hole extending through said lug, and a pair of holes extending through the one of said front and rear sections, such that all three holes are aligned when said lug is fitted into said U-shaped recess, a pin adapted to fit through all three holes when the same are aligned, and wherein said aligning means comprise a groove disposed on an outer surface of said lug extending in a direction substantially parallel to the mean vertical longitudinal plane, a seat formed along an edge of said U-shaped recess, and a sphere adapted to be partially accomodated in said seat and in said groove.

2. The ski of claim 1, wherein said pair of holes are threaded and said pin is at least partially threaded.

3. The ski of claim 2, wherein said lug extends from said front section and said recess is formed in said rear section.

4. The ski of claim 1, wherein said front and rear sections are hollow.

5. The ski of claim 1, additionally comprising a movable fin disposed upon said front section.

6. The ski of claim 1, additionally comprising at least one fin affixed to said rear section.

7. The ski of claim 1, wherein said front and rear sections are removably interconnected.

8. The ski of claim 1, wherein said foot receiving means are disposed upon an upper surface of said front section.

9. The ski of claim 8, wherein said foot receiving means comprise a base plate, and pivoting means dividing said base plate into a front portion and a rear portion such that said portions of said base plate are pivotable with respect to one another.

10. The ski of claim 9, wherein said pivoting means are constituted by a transversely-extending groove across said base plate.

11. The ski of claim 10, wherein said front portion of said base plate is affixed to the upper surface of said front section of said elongated body, such that said rear portion of said base plate is pivotable with respect to said front portion thereof.

12. The ski of claim 11, additionally comprising footwear secured to said front and rear portions of said base plate.

13. The ski of claim 1, additionally comprising at least one groove extending transversely across a top surface of said ski, for receiving a rod therewithin, and means for clamping said rod within said groove.

14. A water ski, comprising an elongated body, said elongated body composed of a plurality of floating sections, a front section and a rear section, means for receiving a foot, said foot receiving means associated with said front section of said elongated body, and an articulated joint interconnecting said front and rear sections of said elongated body, said articulated joint being pivoted about a mean vertical longitudinal plane of said elongated body, at least one groove extending transversely across a top surface of said ski, for receiving a rod therewithin, and means for clamping said rod within said groove, wherein said clamping means comprise a supporting block secured to an upper surface of said elongated body adjacent said groove, and having two substantially parallel projections, a transverse pin extending between said projections, a lever rotatably disposed about said pin, said lever comprising two substantially parallel jaws, a second pin extending between said two jaws, and a clamping element pivoted about said second pin and having an end opposite said jaws which is adapted to clamp said rod within said groove, and to move away from said groove upon rotation of said lever, allowing for removal of said rod from said groove.

15. The ski of claim 14, wherein said rod is adapted to be clamped by an adjacent ski to form a catamaran structure with two skis, and to be separated from the ski and grasped by an individual to constitute means for aiding movement with the ski.

16. A water ski, comprising an elongated body, said elongated body composed of a plurality of floating sections, a front section and a rear section, means for receiving a foot, said foot receiving means associated with said front section of said elongated body, an articulated joint interconnecting said front and rear section of said elongated body, said articulated joint being pivoted about a mean vertical longitudinal plane of said elongated body, at least one groove extending transversely across a top surface of said ski, for receiving a rod therewithin, and means for clamping said rod within said groove, wherein said rod is adapted to be clamped by an adjacent ski to form a catamaran structure with two skis and to be separated from the ski and grasped by an individual to constitute means for aiding movement with the ski, and wherein said rod comprises an elongated member, a substantially closed hollow body rotatably disposed about said elongated member, and a crown of inclined blades disposed upon said hollow body.

17. The ski of claim 16, wherein said rod additionally comprises a handle disposed on an end of said elongated member, and a strap disposed upon said handle.

18. The ski of claim 16, wherein said hollow body is coaxially mounted about said elongated member to rotate about a longitudinal axis thereof.

19. The ski of claim 5, additionally comprising spring means for biasing said movable fin in an outwardly direction from said elongated body.

* * * * *